US006032285A

United States Patent [19]

Densen

[11] Patent Number: 6,032,285

[45] **Date of Patent: *Mar. 7, 2000**

[54] PROTECTIVE GARMENT HAVING EXPANDABLE HOOD AND FEET PORTIONS

[76] Inventor: Larry Densen, 3 Hyanis Ct., Mount Sinai, N.Y. 11766

[ * ] Notice: This patent is subject to a terminal disclaimer.

[21] Appl. No.: 08/313,739

[22] Filed: Sep. 27, 1994

[51] Int. Cl.[7] ..... A41D 13/00

[52] U.S. Cl. ..... 2/2; 2/69

[58] Field of Search ..... 2/2, 69, 69.5, 79, 2/80, 84, 202–205, 239, 242, 409

[56] References Cited

U.S. PATENT DOCUMENTS

| | | | |
|---|---|---|---|
| 1,466,726 | 9/1923 | Meeks | 2/2 |
| 2,255,708 | 9/1941 | Laughton | 2/204 |
| 3,100,897 | 8/1963 | Langer | 2/80 |

*Primary Examiner*—C. D. Crowder
*Assistant Examiner*—Gloria Hale
*Attorney, Agent, or Firm*—Meltzer, Lippe, Goldstein & Schlissel, PC

[57] ABSTRACT

A disposable protective garment to to be worn over a worker's street or working clothing.

4 Claims, 3 Drawing Sheets

PROTECTIVE GARMENT HAVING EXPANDABLE HOOD AND FEET PORTIONS

FIELD OF THE INVENTION

The present invention relates to protective garments and particularly to disposable protective garments to be worn over a worker's street or working clothing.

BACKGROUND OF THE INVENTION

As a result of the increased awareness of the need to protect workers from environmental hazards such as chemicals, pesticides, asbestos and the like, there has been an increased demand and use of disposable protective garments which are worn over a worker's street or working clothes. One type of garment in common use is a thin plastic coverall which includes a hood, body section with arms, legs, and shoe or boot covers in a single garment having a long opening from the chin down to the crotch which permits the wearer to step into the garment and then close the front opening, usually with a zipper or VELCRO hook and loop type fasteners.

One of the disadvantages of the available garments of this type is that a single garment cannot readily accommodate head gear worn by the individual, such as a gas mask or a hard hat. In addition, the feet of the garment cannot easily accommodate shoes or boots of varying sizes so that different garments may be required for different individuals and for different applications and uses.

SUMMARY OF THE INVENTION

It is an object of the present invention to provide a disposable coverall garment which will adjust to various shoe sizes and types and which will adjust to individuals wearing no hat or head gear or wearing protective head gear such as a hard hat, gas mask or the like.

Still another object of this invention is to provide an improved protective garment suitable for individuals of greatly varying size and shape.

Yet another object of this invention is to provide disposable protective garment with a boot section which will accommodate a variety of shoe or boot sizes. This invention relates to which is simple and economical in its parts and operation.

BRIEF DESCRIPTION OF THE DRAWINGS

With these and other objects not specifically mentioned in view, the invention consists in certain combinations and constructions which will be fully described hereinafter, and then set forth in the claims hereunto appended.

In the accompanying drawings which form a part of this specification, and in which like characters of reference indicate the same or like parts.

DETAILED DESCRIPTION OF THE DRAWINGS

Figure 1:
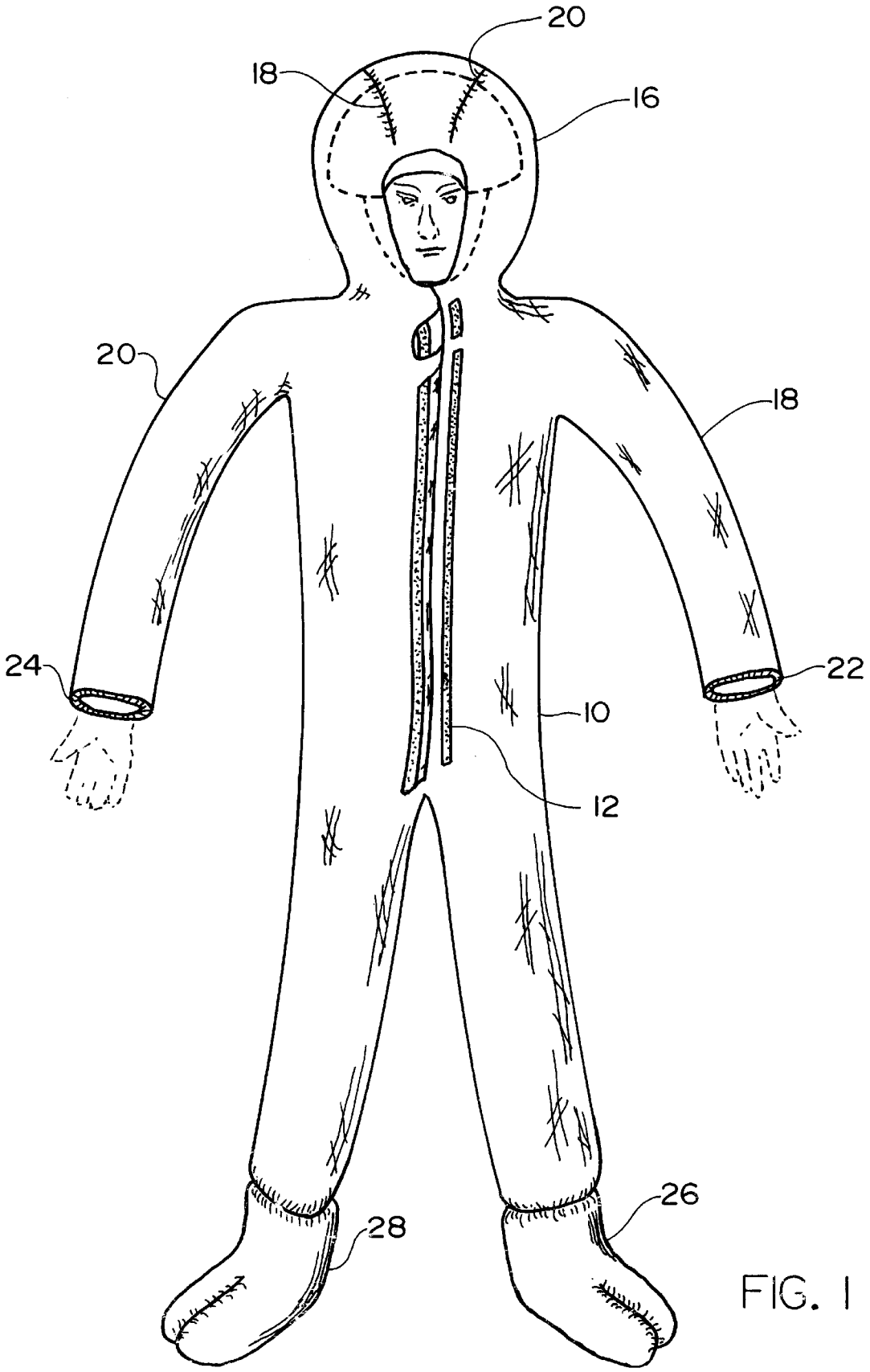
FIG. 1 is a front elevational view of a protective garment embodying features of the present invention.
Figure 2:
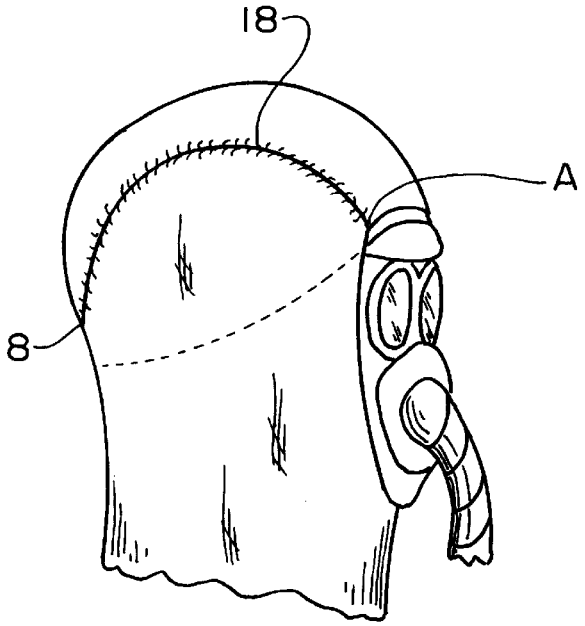
FIG. 2 is an enlarged elevational view of the hood of the garment shown in FIG. 1.
Figure 3:
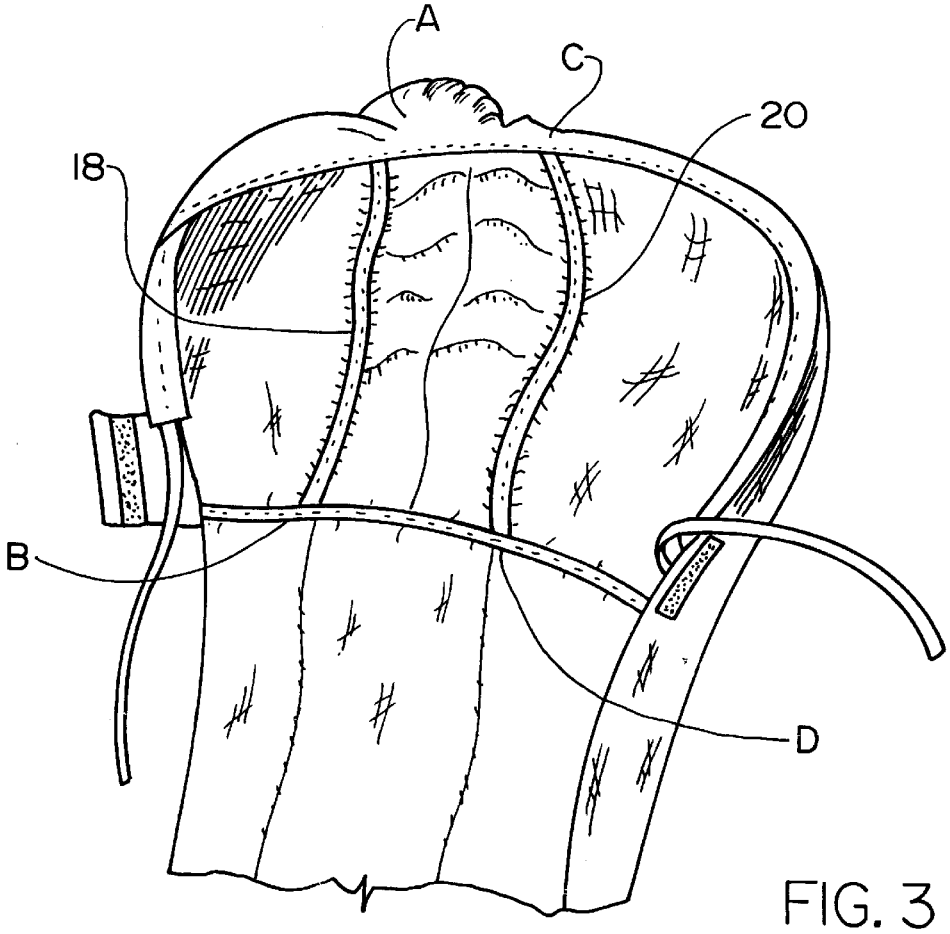
FIG. 3 is an enlarged view of the inside of the hood of the garment shown in FIG. 1 illustrating the elastic band sewn on the inside of the hood.

In the description which follows, like parts are marked throughout the specifications and drawings with the same reference numerals, respectively.

While a particular embodiment of the invention has been shown and described, modifications may be made, and it is intended in the appended claims to cover all such modifications as may fall within the true spirit and scope of the invention.

In order to fully disclose a preferred form of the invention, reference is now made to the drawings and particularly to FIG. 1 which shows a protective garment 10 embodying features of the present invention. The garment 10 is of the type which might be worn by a worker in a hazardous chemical environment such as in the removal of asbestos or in dealing with corrosive chemicals.

The garment is a coverall including a conventional closure along the front which may be either a VELCRO hook and loop type closure, a zipper closure or even buttons, although the VELCRO hook and loop closure is preferred, particularly if the worker is wearing gloves. The garment includes a chin strap closure for bringing the hood of the garment closely around the face of the wearer or if the wearer is wearing a helmet or gas mask then closely around the front of the gas mask or helmet. In the embodiment shown, the arms of the garment terminate in an elastic enclosed wrist opening, although the garment may be designed to include gloves as part of the single piece garment. The legs of the garment terminate in boots which are an integral part of the garment and which are sufficiently large to accommodate the largest shoe or boot size which may be worn by the individual using the garment.

The hood of the garment is sufficiently large to accommodate the largest head gear which would normally be expected to be worn by the individual using the garment and this could be, for example, a combination of a gas mask and a hard hat.

Figure 4:
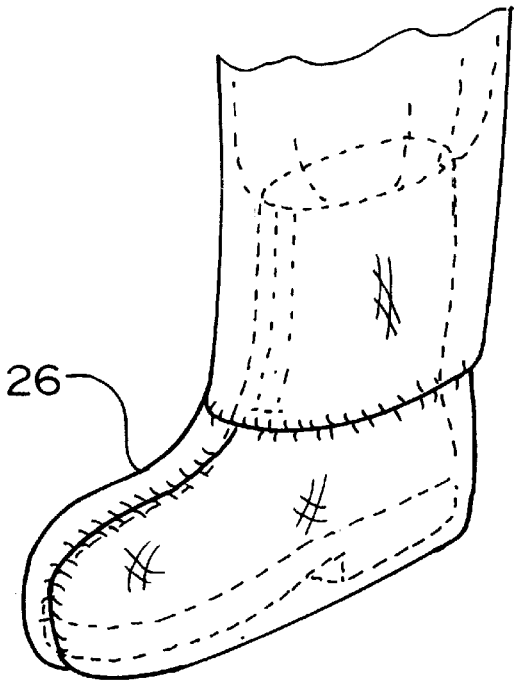
FIG. 4 is a view of the boot of the garmet.
Figure 5:
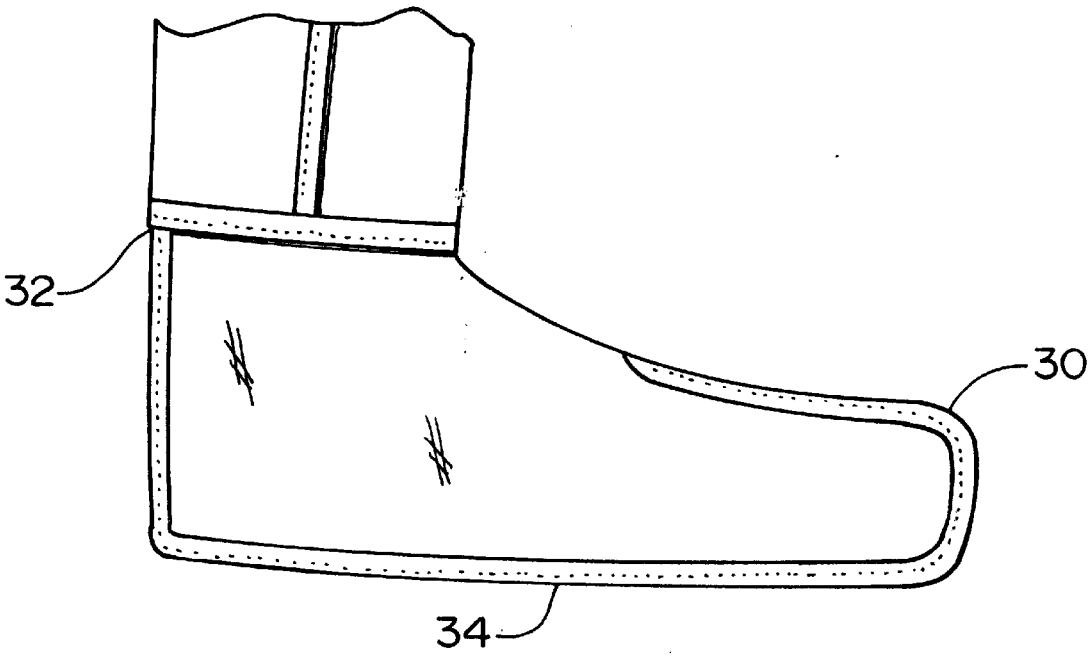
FIG. 5 is a cross section of the boot of the garment shown in FIG. 1 illustrating the elastic band sewn to the inside of the boot.

Referring now to FIG. 4, there is shown an elastic band material which is sewn along the inside center of the boot from the upper part of the heel along the bottom of the boot and along the inside of the toe portion of the boot. When the garment is manufactured, the elastic is stretched out along the length of the center of the inside of the boot as it is sewn to the garment material. When the sewing is complete, the elastic band material will pull on the boot material, thereby puckering the material and reducing the size of the boot in the relaxed condition when it is not being worn. When a worker puts his shoe or boot into the boot of the garment, the elastic will expand to accommodate the wearer's shoes or boot and will fit snugly around the wearer's foot with the excess material being puckered or bunched around the boot of the garment itself and not extending beyond the foot of the wearer where it may interfere with his movement or cause him to trip.

Referring now to the hood of the garment, elastic band material is sewn from a point A at the front edge of the top right front portion of the hood to a point B at the back right of the neck portion of the hood. Another elastic band is sewn on the left side of the hood between a point C on the top left front portion of the neck, and a point D at the back right. Although two elastic bands are shown, additional elastic bands may be utilized in special applications so that there could be a single elastic band down the center with two side bands to provide a closer fit.

What is claimed is:

1. A protective garment comprising:

a body portion, sleeves attached to the body portion, legs ending in feet attached to the body portion and a hood attached to the the body portion, said hood having a front and rear portion, said protective garment having means for opening the body portion to permit donning by a wearer, said hood being of sufficient size to enclose a hard hat or other head covering and having at least one elastic strip attached on a line from the front of the hood to the rear of the hood whereby the hood is close fitting when the wearer of the garment has no head covering and will expand and remain close fitting when the wearer of the garment is wearing a hard hat or other hat, and the feet of the garment have at least one elastic strip running along a line from a front portion of the foot to a rear portion of the foot whereby the feet of the garment will be close fitting to the shoe of the wearer.

2. A protective garment comprising:

a body portion:

a hood portion attached to the body portion, said hood portion having symmetrical left and right sides and a center line dividing said left and right sides, said hood portion having an open front and a closed back and elastic strips attached along lines running from the front to the back of the hood whereby the material of the hood is puckered to reduce the size of the hood and the hood is expandable to accommodate a variety of head sizes and head gear;

leg portions attached to the body portion;

feet portions attached to the ends of the leg portions, said feet portions having a front corresponding to the toe of a human foot and a rear corresponding to the heel of a human foot, said feet portions having elastic strips attached along lines running from the front to the back of the feet portions whereby the material of the feet portions is puckered to reduce the size of the feet portions and the feet portions are expandable to accommodate a variety of foot sizes and foot gear.

3. The protective garment of claim 2 wherein there are at least two elastic strips, each elastic strip being parallel to and laterally spaced on one side of the center line of the hood.

4. The protective garment of claim 2 wherein the elastic strips are extendable to accommodate the size of the headwear and footwear worn by a person wearing the protective garment.

* * * * *